US010225660B2

(12) United States Patent
Wang et al.

(10) Patent No.: US 10,225,660 B2
(45) Date of Patent: Mar. 5, 2019

(54) PROCESS FOR MAGNETIZING MULTIPLE MAGNETIC CIRCUITS

(71) Applicant: GOERTEK INC., Weifang (CN)

(72) Inventors: Bin Wang, Weifang (CN); Qiang Wang, Weifang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/577,246

(22) PCT Filed: Dec. 18, 2015

(86) PCT No.: PCT/CN2015/097966

§ 371 (c)(1),
(2) Date: Nov. 27, 2017

(87) PCT Pub. No.: WO2016/206329

PCT Pub. Date: Dec. 29, 2016

(65) Prior Publication Data

US 2018/0167736 A1 Jun. 14, 2018

(30) Foreign Application Priority Data

Jun. 23, 2015 (CN) ..... 2015 1 0351273

(51) Int. Cl.
*H01F 7/06* (2006.01)
*H04R 9/02* (2006.01)
(Continued)

(52) U.S. Cl.
CPC ..... *H04R 9/025* (2013.01); *H01F 7/06* (2013.01); *H01F 13/003* (2013.01); *H01F 41/00* (2013.01); *H04R 9/06* (2013.01); *H04R 31/00* (2013.01)

(58) Field of Classification Search
CPC .. H04R 9/025; H04R 9/06; H01F 7/06; H01F 41/00
See application file for complete search history.

(56) References Cited

U.S. PATENT DOCUMENTS 6,888,433 B2 * 5/2005 Hamaguchi ..... H04R 9/025 269/216
7,626,291 B2 * 12/2009 Yasuda ..... H02K 37/20 310/156.39

(Continued)

FOREIGN PATENT DOCUMENTS

CN 102204278 A 9/2011
CN 203840532 U 9/2014

(Continued)

*Primary Examiner* — Paul D Kim
(74) *Attorney, Agent, or Firm* — Arent Fox, LLP

(57) ABSTRACT

A process for magnetizing multiple magnetic circuits. The process comprises the following steps: S1, fixing an un-magnetized internal magnetic circuit assembly (12) to an un-magnetized external magnetic circuit assembly (22), so as to assemble into an un-magnetized magnetic circuit assembly (32); and S2, magnetizing the un-magnetized magnetic circuit assembly (32) that is completed in the Step S1, in this step the un-magnetized internal magnetic circuit assembly (12) and the un-magnetized external magnetic circuit assembly (22) are magnetized respectively by using an internal magnetic circuit magnetizing coil (40) and an external magnetic circuit magnetizing coil (50), so as to complete the process for magnetizing multiple magnetic circuits.

4 Claims, 3 Drawing Sheets

(51) Int. Cl.

| | |
|---|---|
| ***H04R 9/06*** | (2006.01) |
| ***H01F 41/00*** | (2006.01) |
| ***H04R 31/00*** | (2006.01) |
| ***H01F 13/00*** | (2006.01) |

(56) References Cited

U.S. PATENT DOCUMENTS

| | | | | |
|---|---|---|---|---|
| 7,848,536 | B2 * | 12/2010 | Sadaie | H04R 9/045 381/401 |
| 2011/0156544 | A1 * | 6/2011 | Jakobsen | B62J 6/06 310/67 R |
| 2011/0291780 | A1 | 12/2011 | Takahashi et al. | |
| 2014/0035707 | A1 | 2/2014 | Fullerton et al. | |
| 2015/0139479 | A1 | 5/2015 | Lai et al. | |

FOREIGN PATENT DOCUMENTS

| | | | |
|---|---|---|---|
| CN | 203851286 | U | 9/2014 |
| CN | 204031439 | U | 12/2014 |
| CN | 204305346 | U | 4/2015 |
| CN | 104602177 | A | 5/2015 |
| CN | 105006334 | A | 10/2015 |

* cited by examiner

PROCESS FOR MAGNETIZING MULTIPLE MAGNETIC CIRCUITS

CROSS REFERENCE TO RELATED APPLICATIONS

This application is a National Stage entry of International Application No.: PCT/CN2015/097966, filed on Dec. 18, 2015, which claims priority to Chinese Patent Application No. 201510351273.5, filed on Jun. 23, 2015. The disclosure of the priority applications are hereby incorporated in their entirety by reference.

TECHNICAL FIELD

The present disclosure relates to the technical field of electroacoustic products, and particularly relates to a process for magnetizing multiple magnetic circuits.

BACKGROUND ART

The loudspeaker module is an important acoustic component in portable electronic devices. As an energy conversion device, it is used to complete the conversion between an electrical signal and an acoustic signal. A conventional loudspeaker comprises a vibration assembly and a magnetic circuit assembly, most magnetic circuit assemblies comprise an internal magnetic circuit assembly and an external magnetic circuit assembly, and the external magnetic circuit assembly surrounds the periphery of the internal magnetic circuit assembly. During the assembling of loudspeakers, it is required to magnetize the internal magnetic circuit assembly and the external magnetic circuit assembly, and make the polarities of the internal magnetic circuit assembly and the external magnetic circuit assembly opposite.

Presently, the process of magnetizing such multi-magnetic-circuit magnetic circuit assemblies comprises the following steps, as shown in FIG. 1*a*, FIG. 1*b* and FIG. 1*c:* the first step: an un-magnetized internal magnetic circuit assembly 12 is magnetized by an internal magnetic circuit magnetizing coil 40 to form an internal magnetic circuit assembly 10 after the magnetizing finishes. In the internal magnetic circuit assembly 10, the upper end is the N pole and the lower end is the S pole (only if the electric current direction is as shown in the figures; if the electric current direction is opposite, the magnetic poles after magnetizing are also opposite);

the second step: an un-magnetized external magnetic circuit assembly 22 is magnetized by an external magnetic circuit magnetizing coil 50 to form an external magnetic circuit assembly 20 after the magnetizing finishes. In the external magnetic circuit assembly 20, the upper end is the S pole and the lower end is the N pole; and the third step: the internal magnetic circuit assembly 10 is fixed to the external magnetic circuit assembly 20 using an adhesive, to form the finished product of magnetic circuit assembly 30.

The above process for magnetizing multiple magnetic circuits in which the magnetic circuit assemblies are magnetized first and then adhesively fixed has the following defects:

first, since part of the magnetism will be eliminated at a high temperature, only the adhesives that have a relatively low solidification temperature can be selected to adhesively bond the internal magnetic circuit assembly and the external magnetic circuit assembly. The long solidification duration of these adhesives results in low production efficiency of multi-magnetic-circuit magnetic circuit assemblies;

second, the adhesives that have a relatively low solidification temperature usually have a relatively small adhesion force, which cannot satisfy the requirements on the products. Moreover, available adhesives that have large adhesion force and low solidification temperature are few and expensive, which increases the production cost of the products; and third, because after the magnetizing the polarities of the internal magnetic circuit assembly and the external magnetic circuit assembly are opposite, they have a certain attraction force therebetween, which greatly increases the difficulty in the step of adhesive bonding, and further reduces the production efficiency.

SUMMARY OF THE DISCLOSURE

Regarding the above defects, the technical problem that the present disclosure seeks to solve is to provide a process for magnetizing multiple magnetic circuits, in which the process is simply and easy to operate, more types of adhesive can be selected, the production efficiency is high, and the production cost is low.

In order to solve the above technical problem, the technical solution of the present disclosure is:

a process for magnetizing multiple magnetic circuits, comprising the following steps: S1, fixing an un-magnetized first magnetic circuit assembly to an un-magnetized second magnetic circuit assembly, so as to assemble into an un-magnetized magnetic circuit assembly; and S2, magnetizing the un-magnetized magnetic circuit assembly that is completed in the Step S1, in this step the un-magnetized first magnetic circuit assembly and the un-magnetized second magnetic circuit assembly are magnetized respectively by using a first magnetic circuit magnetizing coil and a second magnetic circuit magnetizing coil, so as to complete the process for magnetizing multiple magnetic circuits.

As an embodiment, in the Step S2, the un-magnetized second magnetic circuit assembly is magnetized first by the second magnetic circuit magnetizing coil, and after the magnetizing of the second magnetic circuit assembly is completed, the un-magnetized first magnetic circuit assembly is magnetized by the first magnetic circuit magnetizing coil, to complete the process for magnetizing multiple magnetic circuits.

As anther embodiment, in the Step S2, the un-magnetized first magnetic circuit assembly is magnetized first by the first magnetic circuit magnetizing coil, and after the magnetizing of the first magnetic circuit assembly is completed, the un-magnetized second magnetic circuit assembly is magnetized by the second magnetic circuit magnetizing coil, to complete the process for magnetizing multiple magnetic circuits; during the un-magnetized second magnetic circuit assembly is magnetized, magnetic shielding components are provided on the upper side and the lower side of the magnetized first magnetic circuit assembly respectively.

Optionally, the un-magnetized first magnetic circuit assembly is fixed to the un-magnetized second magnetic circuit assembly by an adhesive.

Optionally, the adhesive is one of polyurethane low-temperature hot melt adhesive, EVA low-temperature hot melt adhesive, anaerobic thermosetting adhesive and epoxy thermosetting adhesive.

By employing the above technical solutions, the advantageous effects of the present disclosure are:

In the process for magnetizing multiple magnetic circuits of the present disclosure, an un-magnetized first magnetic circuit assembly is fixed to an un-magnetized second magnetic circuit assembly, to form a magnetic circuit assembly, and then the first magnetic circuit assembly and the second magnetic circuit assembly are magnetized respectively by a first magnetic circuit magnetizing coil and a second magnetic circuit magnetizing coil, and the process for magnetizing multiple magnetic circuits is completed when the magnetizing is completed. Therefore, compared with the process of the prior art in which the magnetic circuit assemblies are magnetized individually first and then assembled, such a process in which the magnetic circuit assemblies are assembled first and then integrally magnetized has the following advantages:

First, the magnetizing process is simpler, and the magnetizing efficiency is higher.

Second, if the magnetic circuit assemblies are assembled first (the first and the second magnetic circuits are adhesively fixed) and then magnetized, the solidification temperature of the adhesive will not affect the magnetism. Therefore, more types of adhesive can be selected, and some adhesives that have high solidification temperature, high adhering force and low cost may be selected.

Third, when the first magnetic circuit assembly and the second magnetic circuit assembly are adhesively bonded, neither of the first magnetic circuit assembly and the second magnetic circuit assembly has magnetism. Therefore, they have no attraction force therebetween, so the adhesive bonding is easier, and the production efficiency is higher.

In conclusion, the process for magnetizing multiple magnetic circuits of the present disclosure solves the technical problems of the process for magnetizing multiple magnetic circuits of the prior art that the steps are complicated and the types of selectable adhesives are few. In the process for magnetizing multiple magnetic circuits of the present disclosure, the steps are simplified, the operation difficulty in the process is reduced, more types of adhesive can be selected, and the production efficiency is high.

The above description is only an overview of the technical solutions of the present disclosure. In order to understand the technical means of the present disclosure more clearly, the special embodiments of the present disclosure are provided below.

BRIEF DESCRIPTION OF THE DRAWINGS

The drawings are intended to provide a further understanding of the present disclosure, and constitute a part of the description. The drawings are intended to interpret the present disclosure along with the embodiments of the present disclosure, and do not constitute a limit to the present disclosure. In the drawings.

Figure 1A:
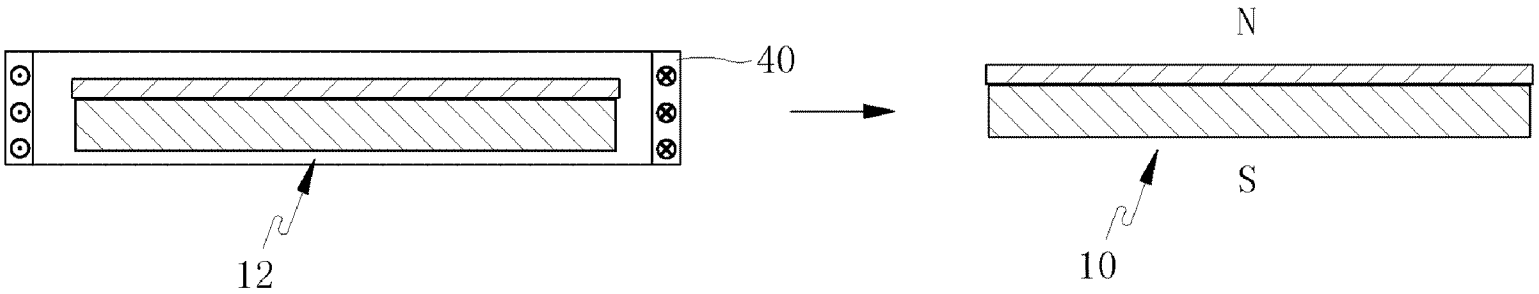
FIG. 1*a* is the first step of the flow chart of the process for magnetizing multiple magnetic circuits of the prior art.
Figure 1B:
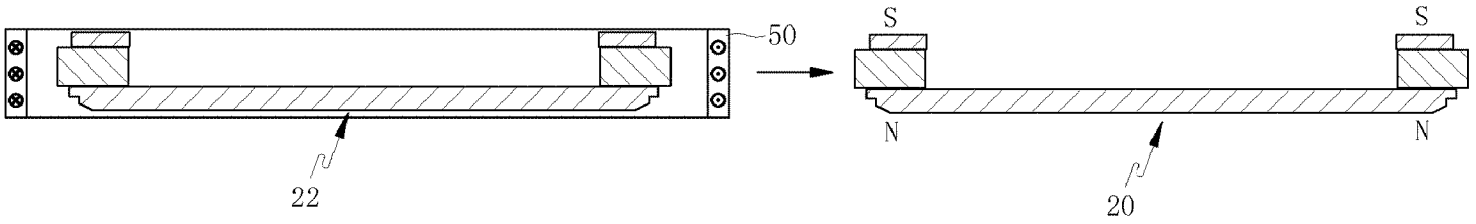
FIG. 1*b* is the second step of the flow chart of the process for magnetizing multiple magnetic circuits of the prior art.
Figure 1C:
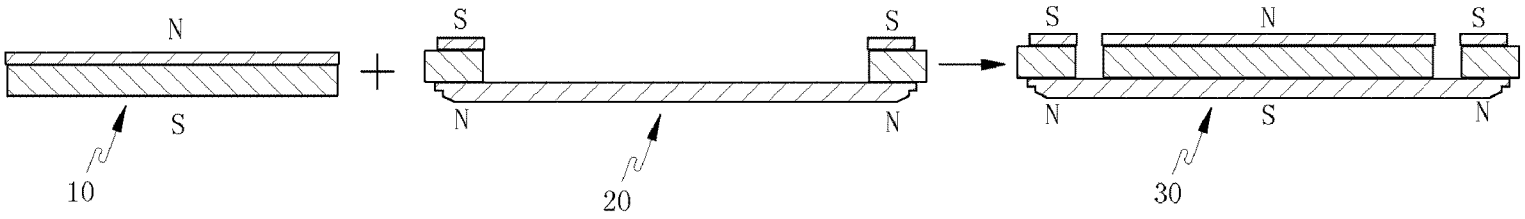
FIG. 1*c* is the third step of the flow chart of the process for magnetizing multiple magnetic circuits of the prior art.

In the drawings: 10, internal magnetic circuit assembly; 12, un-magnetized internal magnetic circuit assembly; 20, external magnetic circuit assembly; 22, un-magnetized external magnetic circuit assembly; 30, finished product of magnetic circuit assembly; 32, un-magnetized magnetic circuit assembly; 34, partially magnetized magnetic circuit assembly; 40, internal magnetic circuit magnetizing coil; 50, external magnetic circuit magnetizing coil; 60, magnetic shielding components; 100, internal magnet; 102, internal spring washer; 104, external magnet; 106, external spring washer; 108, concentrating flux plate; and 200, magnetic gap.

DETAILED DESCRIPTION

In order to make the objects, technical solutions and advantages of the present disclosure clearer, the present disclosure is further illustrated below in conjunction with the drawings and embodiments.

As shown in FIG. 2*a*, FIG. 2*b*, FIG. 3*a* and FIG. 3*b*, a process for magnetizing multiple magnetic circuits comprises the following steps:

S1, fixing an un-magnetized first magnetic circuit assembly to an un-magnetized second magnetic circuit assembly, so as to assemble into an un-magnetized magnetic circuit assembly; and S2, magnetizing the un-magnetized magnetic circuit assembly that is completed in the Step S1, in this step the un-magnetized first magnetic circuit assembly and the un-magnetized second magnetic circuit assembly are magnetized respectively by using a first magnetic circuit magnetizing coil and a second magnetic circuit magnetizing coil so as to complete the process for magnetizing multiple magnetic circuits.

The multi-magnetic-circuit assemblies may comprise two magnetic circuits, three magnetic circuits, four magnetic circuits and so on. Because a two-magnetic-circuit magnetic circuit assembly is more common, the process for magnetizing multiple magnetic circuits of the present disclosure will be illustrated in detail below by taking the example of a two-magnetic-circuit magnetic circuit assembly.

Figure 2A:
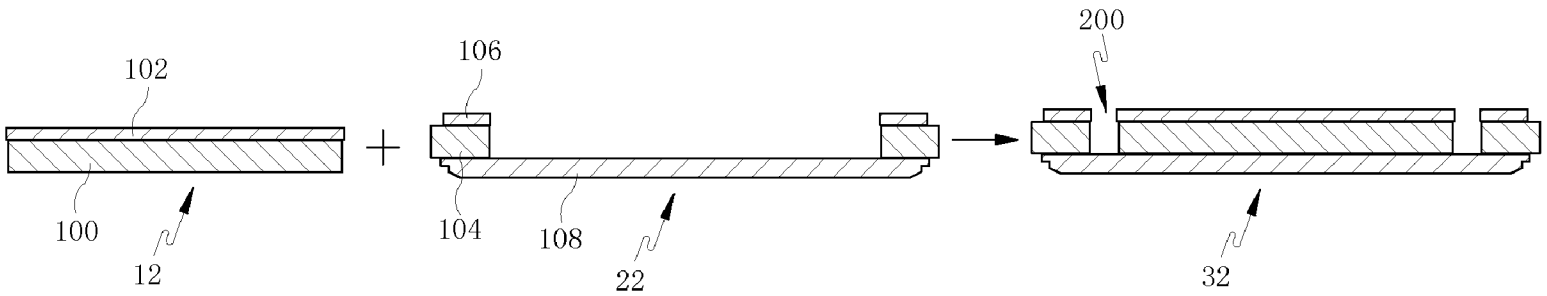
FIG. 2*a* is the first step of the flow chart of the first embodiment of the process for magnetizing multiple magnetic circuits of the present disclosure.

As shown in FIG. 2*a*, a magnetic circuit assembly that is provided with two magnetic circuits comprises an internal magnetic circuit and an external magnetic circuit, the internal magnetic circuit comprises an internal magnet 100 and an internal spring washer 102, and the external magnetic circuit comprises an external magnet 104 and an external spring washer 106. Both the external magnetic circuit and the internal magnetic circuit are adhesively fixed to a concentrating flux plate 108. The external magnetic circuit surrounds the periphery of the internal magnetic circuit, and a gap is left between the internal magnetic circuit and the external magnetic circuit. The gap is the magnetic gap 200.

First Embodiment

Figure 2B:
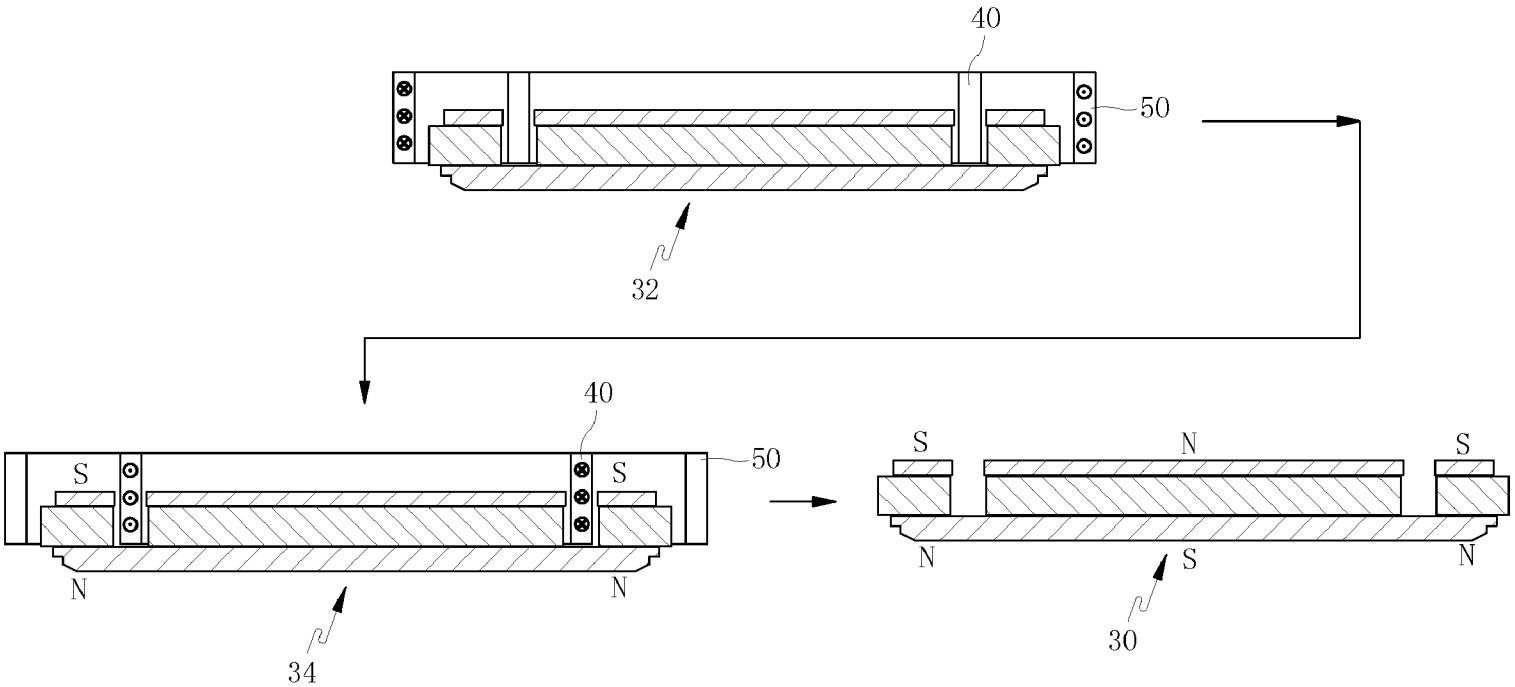
FIG. 2*b* is the second step of the flow chart of the first embodiment of the process for magnetizing multiple magnetic circuits of the present disclosure.

As shown jointly by FIG. 2*a* and FIG. 2*b*, a process for magnetizing multiple magnetic circuits comprises the following steps:

The First Step:

Referring to FIG. 2*a*, an un-magnetized internal magnetic circuit assembly 12 (the first magnetic circuit assembly) is fixed to the center part of an un-magnetized external magnetic circuit assembly 22 (the second magnetic circuit assembly) using an adhesive, to combine into an un-magnetized magnetic circuit assembly 32.

The adhesive may be selected from polyurethane low-temperature hot melt adhesive, EVA low-temperature hot melt adhesive (whose major components are ethylene and vinyl acetate), anaerobic thermosetting adhesive and epoxy thermosetting adhesive, etc. These four adhesives are preferable types of the present embodiment, but the present embodiment is not limited to these four types.

The Second Step:

Referring to FIG. 2*b*, the un-magnetized magnetic circuit assembly 32 is magnetized using a magnetizing device. An internal magnetic circuit magnetizing coil 40 is provided within the magnetic gap 200, and an external magnetic circuit magnetizing coil 50 is provided outside of the un-magnetized magnetic circuit assembly 32.

The external magnetic circuit magnetizing coil 50 (the second magnetic circuit magnetizing coil) is electrified, and the electric current direction is as shown in the figure, ⊙ represents that the electric current direction is coming perpendicularly out of the paper, and ⊗ represents that the electric current direction is going perpendicularly into the paper. At this point the internal magnetic circuit magnetizing coil 40 is not electrified. According to the right hand rule, the un-magnetized external magnetic circuit assembly 22 is magnetized by the magnetic field that is generated by the external magnetic circuit magnetizing coil 50, and forms a magnetic body in which the upper part is the S pole and the lower part is the N pole. At this point the magnetic circuit assembly becomes a partially magnetized magnetic circuit assembly 34.

After the magnetizing of the external magnetic circuit assembly is completed, the power to the external magnetic circuit magnetizing coil 50 is disconnected. Then the power supply to the internal magnetic circuit magnetizing coil 40 (the first magnetic circuit magnetizing coil) is turned on to magnetize the internal magnetic circuit assembly in the partially magnetized magnetic circuit assembly 34; the direction of the electric current that passes through the internal magnetic circuit magnetizing coil 40 is opposite to that of the electric current of the external magnetic circuit magnetizing coil 50. Likewise, according to the right hand rule, the internal magnetic circuit assembly is polarized by the magnetic field that is generated by the internal magnetic circuit magnetizing coil 40 and forms a magnetic body in which the upper part is the N pole and the lower part is the S pole. At this point the power to the internal magnetic circuit magnetizing coil 40 is disconnected, and the magnetizing process of the multi-magnetic-circuit assemblies is completed. The finished product of magnetic circuit assembly 30 in which polarities of the internal magnetic circuit and the external magnetic circuit are opposite is formed.

In the present embodiment, the external magnetic circuit assembly that is magnetized first is located out of the magnetic field that is generated by the internal magnetic circuit magnetizing coil 40, and thus the magnetizing of the internal magnetic circuit will not affect the magnetized external magnetic circuit. Therefore, the polarity of the finished product of magnetic circuit assembly 30 is stable, and the magnetizing process is simple and easy to operate.

Second Embodiment

Figure 3A:
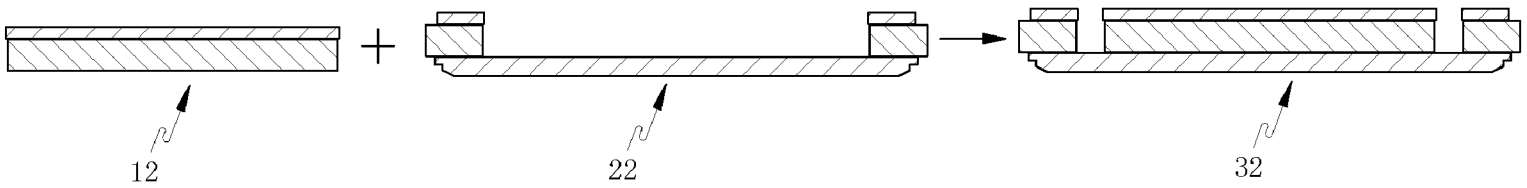
FIG. 3*a* is the first step of the flow chart of the second embodiment of the process for magnetizing multiple magnetic circuits of the present disclosure.
Figure 3B:
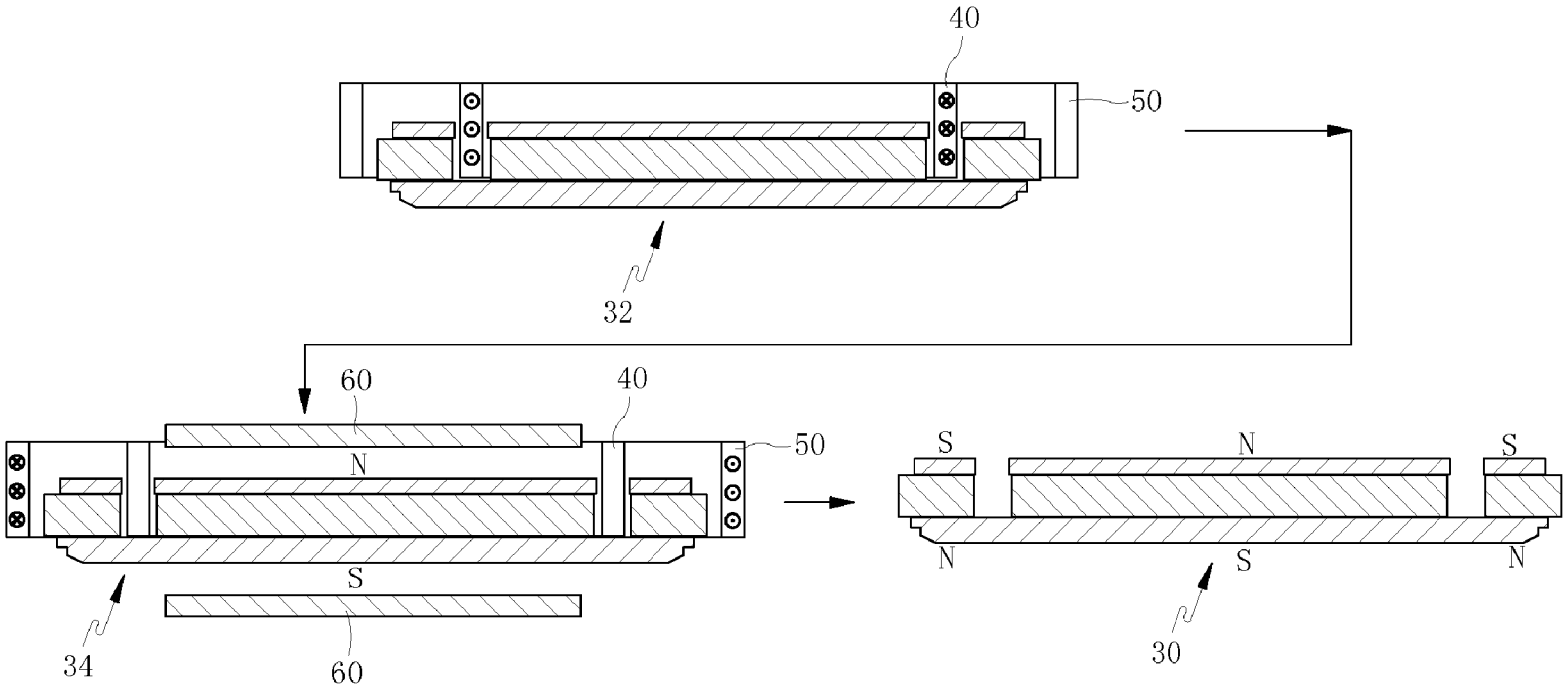
FIG. 3*b* is the second step of the flow chart of the second embodiment of the process for magnetizing multiple magnetic circuits of the present disclosure.

The present embodiment is basically the same as the first embodiment, and the differences are as follows:

As shown jointly by FIG. 3*a* and FIG. 3*b*, the first step (referring to FIG. 3*a*) is the same as the first step of the first embodiment, and is not described in detail here.

The Second Step:

Referring to FIG. 3*b*, the power supply to the internal magnetic circuit magnetizing coil 40 is turned on. At this point the external magnetic circuit magnetizing coil 50 is not electrified. The direction of the electric current that passes through the internal magnetic circuit magnetizing coil 40 is as shown in FIG. 3*b*. Likewise, according to the right hand rule, the internal magnetic circuit assembly is magnetized by the magnetic field that is generated by the internal magnetic circuit magnetizing coil 40, and its upper part is the N pole and its lower part is the S pole.

After the magnetizing of the internal magnetic circuit assembly is completed, the power supply to the internal magnetic circuit magnetizing coil 40 is turned off, and the external magnetic circuit magnetizing coil 50 is electrified. The direction of the electric current that passes through the external magnetic circuit magnetizing coil 50 and the direction of the electric current that passes through the internal magnetic circuit magnetizing coil 40 are opposite. Because at this point both the internal magnetic circuit assembly and the external magnetic circuit assembly are located within the magnetic field that is generated by the external magnetic circuit magnetizing coil 50, it is required that magnetic shielding components 60 are provided on the upper side and the lower side of the magnetized internal magnetic circuit assembly respectively, so that the magnetized internal magnetic circuit assembly is not affected by the magnetic field that is generated by the external magnetic circuit magnetizing coil 50, to ensure that its polarity is not changed or affected. The external magnetic circuit assembly is magnetized by the magnetic field that is generated by the external magnetic circuit magnetizing coil 50 to form the finished product of magnetic circuit assembly 30; its upper part is the S pole and its lower part is the N pole, which are opposite to the polarities of the internal magnetic circuit assembly. Thereby the magnetizing process of the multi-magnetic-circuit assemblies is completed.

The directions of the electric currents that pass through the internal magnetic circuit magnetizing coil 40 and the external magnetic circuit magnetizing coil 50 in the above two embodiments are merely illustrations, and provided that the directions of the electric currents that pass through them are opposite, it is not limited thereto in the practical use.

The above two embodiments are merely detailed illustration of the process for magnetizing multiple magnetic circuits of the present disclosure by taking the example of a two-magnetic-circuit magnetic circuit assembly, but in practice multi-magnetic-circuit magnetic circuit assemblies may include three magnetic circuits, four magnetic circuits, and so on. A person skilled in the art, according to the illustration of the above two embodiments, without paying creative work, can integrally magnetize multi-magnetic-circuit assemblies such as three-magnetic-circuit magnetic circuit assemblies and four-magnetic-circuit magnetic circuit assemblies. Therefore, the special embodiments regarding the magnetizing processes of other multi-magnetic-circuit magnetic circuit assemblies are not described in detail here.

In the process for magnetizing multiple magnetic circuits of the present disclosure, the internal magnetic circuit assembly and the external magnetic circuit assembly are adhesively bonded together first, and then integrally magnetized using magnetizing devices. Thereby, the multi-magnetic-circuit magnetization process is effectively simplified, and the operation difficulty in the process is reduced. Additionally, more types of adhesives can be selected, the production efficiency is high, and the production cost is low.

The present disclosure is not limited to the above special embodiments. Diverse variations made by a person skilled in the art from the above idea without paying creative work shall all fall within the protection scope of the present disclosure.

What is claimed is:

1. A process for magnetizing multiple magnetic circuits, wherein it comprises the following steps:

S1, fixing an un-magnetized internal magnetic circuit assembly to a center part of an un-magnetized external magnetic circuit assembly with a magnetic gap left between the internal magnetic circuit assembly and the external magnetic circuit assembly, so as to assemble into an un-magnetized magnetic circuit assembly; and S2, providing an internal magnetic circuit magnetizing coil within the magnetic gap, providing an external magnetic circuit magnetizing coil outside of the un-magnetized magnetic circuit assembly, and magnetizing the un-magnetized magnetic circuit assembly that is completed in the Step S1, in this step the un-magnetized internal magnetic circuit assembly and the un-magnetized external magnetic circuit assembly are magnetized respectively by using the internal magnetic circuit magnetizing coil and the external magnetic circuit magnetizing coil, so as to complete the process for magnetizing the multiple magnetic circuits.

2. The process for magnetizing multiple magnetic circuits according to claim 1, wherein in the Step S2, the un-magnetized external magnetic circuit assembly is magnetized by the external magnetic circuit magnetizing coil, and after the magnetizing of the external magnetic circuit assembly is completed, the un-magnetized internal magnetic circuit assembly is magnetized by the internal magnetic circuit magnetizing coil, to complete the process for magnetizing the multiple magnetic circuits.

3. The process for magnetizing multiple magnetic circuits according to claim 2, wherein the un-magnetized internal magnetic circuit assembly is fixed to the un-magnetized external magnetic circuit assembly by an adhesive.

4. The process for magnetizing multiple magnetic circuits according to claim 3, wherein the adhesive is one of polyurethane low-temperature hot melt adhesive, EVA low-temperature hot melt adhesive, anaerobic thermosetting adhesive and epoxy thermosetting adhesive.

* * * * *